US006837451B2

(12) United States Patent
Rodriguez-Amaya et al.

(10) Patent No.: US 6,837,451 B2
(45) Date of Patent: Jan. 4, 2005

(54) SEAT/SLIDE VALVE WITH PRESSURE-EQUALIZING PIN

(75) Inventors: Nestor Rodriguez-Amaya, Stuttgart (DE); Achim Brenk, Kaempfelbach-Bilfingen (DE); Wolfgang Klenk, Loechgau (DE); Uwe Gordon, Kemmern (DE); Manfred Mack, Altheim (DE); Hubert Greif, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/276,149

(22) PCT Filed: Mar. 12, 2002

(86) PCT No.: PCT/DE02/00862

§ 371 (c)(1),
(2), (4) Date: May 9, 2003

(87) PCT Pub. No.: WO02/073028

PCT Pub. Date: Sep. 19, 2002

(65) Prior Publication Data

US 2003/0172978 A1 Sep. 18, 2003

(30) Foreign Application Priority Data

Mar. 13, 2001 (DE) ..... 101 11 929

(51) Int. Cl.[7] ..... F02M 59/46

(52) U.S. Cl. ..... 239/533.2; 137/625.26; 137/625.27; 137/625.65

(58) Field of Search ..... 137/625.26, 625.27, 137/625.65; 239/533.2

(56) References Cited

U.S. PATENT DOCUMENTS

| | | | | |
|---|---|---|---|---|
| 3,995,652 A | * 12/1976 | Belart et al. | ..... | 137/625.65 |
| 4,175,587 A | * 11/1979 | Chadwick et al. | ..... | 137/625.65 |
| 4,643,225 A | * 2/1987 | Imhof | ..... | 137/625.65 |
| 5,396,926 A | * 3/1995 | Pataki et al. | ..... | 137/625.65 |
| 5,497,806 A | * 3/1996 | Swank et al. | ..... | 137/625.65 |
| 5,518,030 A | * 5/1996 | Liu et al. | ..... | 137/625.65 |
| 5,571,248 A | * 11/1996 | Seetharaman et al. | . | 137/625.65 |
| 5,853,028 A | * 12/1998 | Ness et al. | ..... | 137/625.65 |
| 5,918,630 A | * 7/1999 | Lucas et al. | ..... | 137/625.65 |

FOREIGN PATENT DOCUMENTS

| | | |
|---|---|---|
| DE | 196 05 277 A | 8/1996 |
| DE | 197 01 879 A | 7/1998 |
| DE | 197 24 637 A | 12/1998 |
| DE | 199 39 452 A | 3/2001 |
| WO | WO 02 059475 A | 8/2002 |

* cited by examiner

*Primary Examiner*—Gerald A. Michalsky
(74) *Attorney, Agent, or Firm*—Ronald E. Greigg

(57) ABSTRACT

The invention relates to a 3/2-way valve for controlling the injection of fuel in a common rail injection system of an internal combustion engine, having a first switching position, in which an injection nozzle is in communication with a fuel return, and having a second switching position, in which the injection nozzle is in communication with a high-pressure fuel reservoir. To improve the function and quality of the injection, the 3/2-way valve includes a force-balanced control piston, and the control edge of the control piston is pressure-equalized by means of a blind bore.

15 Claims, 4 Drawing Sheets

SEAT/SLIDE VALVE WITH PRESSURE-EQUALIZING PIN

CROSS-REFERENCE TO RELATED APPLICATIONS

This application is a 35 USC 371 application of PCT/DE 02/00862 filed on Mar. 12,2002.

BACKGROUND OF THE INVENTION

1. Field of the Invention

The invention relates to a 3/2-way valve for controlling the injection of fuel in a common rail injection system of an internal combustion engine, having a control piston guided in a valve body, in which the control piston, in a first switching position, opens a hydraulic connection between an injector and a fuel return, and in a second switching position the control piston opens a hydraulic connection between the injector and a high-pressure fuel reservoir.

2. Description of the Prior Art

One 3/2-way valve of the described above is known for instance from German Patent Disclosure DE 197 24 637 A1. In common rail injection systems, a high-pressure fuel pump pumps the fuel into the central high-pressure reservoir, which is known as a common rail. From the rail, high-pressure lines lead to the individual injectors that are assigned to the engine cylinders. The injectors are triggered individually by the engine electronics. When the control valve opens, fuel subjected to high pressure reaches the combustion chamber, moving past the nozzle needle that has lifted counter to the prestressing force of a nozzle spring.

OBJECTS AND SUMMARY OF THE INVENTION

The object of the invention is to improve the function and quality of the injection. Moreover, the control valve of the invention should be of simple construction and capable of being produced economically.

In a 3/2-way valve for controlling the injection of fuel in a common rail injection system of an internal combustion engine, having a control piston guided in a valve body, in which the control piston, in a first switching position, opens a hydraulic connection between an injector and a fuel return, and in a second switching position the control piston opens a hydraulic connection between the injector and a high-pressure fuel reservoir, this object is attained according to the invention in that the control piston is force-balanced.

Because of the complete or partial pressure equalization of the control piston, even the tiniest forces suffice for a control motion of the applicable control piston, so that the control piston is triggerable directly. All the valve faces that are in direct communication with the injection nozzle are designed such that they cannot exert any undesired pressure surges on the control piston. The forces acting on the control pistons during operation originate either in springs or in pressure faces, which during the phase of motion of the control pistons experience no force surges or uncontrolled pressure changes whatever. The size of the metering or diversion cross section can be embodied as arbitrarily large.

In a variant of the invention, it is provided that the control piston has two guides, with a larger guide diameter and a smaller guide diameter; that the control piston has a control edge cooperating with the smaller guide diameter; that a blind bore is embodied in the end, remote from the control edge, of the control piston; that the blind bore can be subjected to pressure via a bore; and that a throttle is provided in the bore. The pressure prevailing in the blind bore generates a force that acts in the closing direction of the control piston. After the opening, this force assures a pressure equalization at the control piston. The magnitude of the force depends on the diameter of the blind bore. If the effective cross-sectional area of the blind bore is equivalent to the annular surface defined by the larger guide diameter and the smaller guide diameter, then the control piston is completely pressure-equalized in a simple way.

In a further supplement to the invention, an additional piston is guided in the blind bore, so that the leakage flow is reduced and the pressure equalization is speeded up.

In another embodiment of the invention, a circumferential groove is embodied on the control piston and in the assembled state of the 3/2-way valve is disposed in the region of at least one fuel return opening, so that the underside of the control piston remains pressureless, and pressure peaks on the control piston during diversion are avoided, which can have a favorable effect on the motion of the control piston, especially in the opening and closing phase. The circumferential groove can also be subjected to an arbitrary pressure from an external pressure source, to exert targeted influence on the motion of the control piston during operation. Moreover, the circumferential groove reduces throttling actions, so that the pressure relief is speeded up.

A particular type of embodiment of the invention is characterized in that the control piston has two guides, with a larger guide diameter and a smaller guide diameter; and that the control piston has a valve seat edge whose diameter is equivalent to the larger guide diameter. As a consequence, upon opening the control piston is completely pressure-equalized. The actuation of the control piston can be done via a magnet to which electric current is supplied, for instance. When current is supplied to the magnet, all that has to be overcome in order to lift the control piston is the prestressing force of the closing spring.

One particular type of embodiment of the invention is characterized in that the face end of one control piston is subjected to the prestressing force of a compression spring. The prestressing force of the compression spring assures that the associated control piston, in one switching position of the 3/2-way valve, is kept with its valve seat edge in contact with the associated valve seat face.

Another particular type of embodiment of the invention is characterized in that the control piston is actuated via a piezoelectric actuator. The use of the piezoelectric actuator makes faster switching times possible than is the case in conventional valves.

The 3/2-way valve of one of the foregoing embodiments is characterized in that it is intended for use with an injection nozzle or a nozzle holder combination, so that the advantages of the 3/2-way valve of the invention are achieved in other systems as well as in common rail injection systems.

In principle, the 3/2-way valves of the invention can be embodied in one piece or in two parts. The control can be effected via a magnet valve or a piezoelectric actuator directly, or via a servo loop. The other possible combinations, although not shown for reasons of simplicity, are also part of the invention for which patent protection is to be claimed.

BRIEF DESCRIPTION OF THE DRAWINGS

Further advantages, characteristics and detailed of the invention will become apparent from the ensuing description, in which various exemplary embodiments of the invention are described in detail in conjunction with the drawing, in which.

DESCRIPTION OF THE PREFERRED EMBODIMENTS

Figure 1:
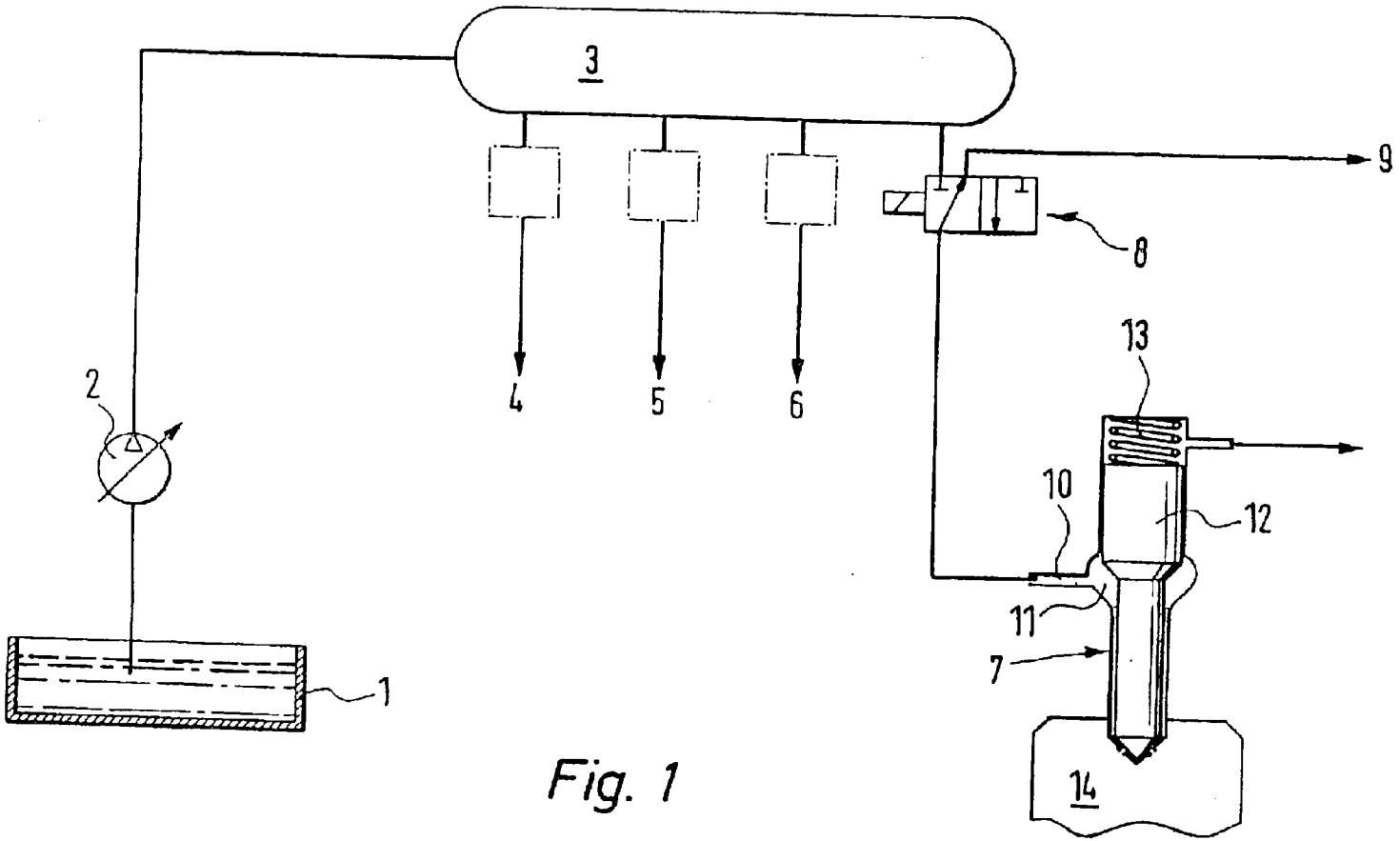
FIG. 1, the schematic illustration of a common rail injection system.

In FIG. 1, a common rail injection system is shown schematically. From a fuel tank 1, fuel is pumped with the aid of a pump unit 2 into a high-pressure fuel reservoir 3 and subjected to high pressure. The fuel subjected to high pressure is then allocated as needed to the various cylinders of the internal combustion engine to be supplied. The injection of the fuel subjected to high pressure is done through injectors 4, 5, 6 and 7.

In FIG. 1, only the injector 7 is shown, for the sake of simplicity. The supply of fuel to the injector 7 is effected via a metering valve 8. Regardless of the embodiment selected, the metering valve 8 can be designed as an independent component group. This makes it possible to mount the valve arbitrarily between the high-pressure fuel reservoir 3 and an injector 7 or the like, thus providing a free choice of line lengths between the high-pressure fuel reservoir 3 and the metering valve 8 and between the metering valve 8 and the injector 7.

The metering valve 8 is a 3/2-way valve, which is actuated electromagnetically. In the switching position shown in FIG. 1, the communication between the high-pressure fuel reservoir 3 and a high-pressure connection 10 of the injector 7 is interrupted. In the switching position of the metering valve 8 shown in FIG. 1, the high-pressure connection 10 of the injector 7 communicates with a fuel return 9.

Upon an actuation of the metering valve 8, a switchover is made to the second switching position, not shown in FIG. 1. In the second switching position, the high-pressure connection 10 of the injector 7 communicates directly with the high-pressure fuel reservoir 3. In this switching position, fuel from the high-pressure fuel reservoir 3 that has been subjected to high pressure flows via the high-pressure connection 10 into a pressure chamber 11, which is embodied in the injector 7. If the pressure in the pressure chamber 11 exceeds a certain value, a nozzle needle 12 prestressed by a nozzle spring 13 lifts from its seat, and fuel subjected to high pressure is injected into the combustion chamber 14 of the engine to be supplied.

The metering valve 8 can be embodied as a so-called seat/slide valve. In a seat/slide valve, one sealing face is embodied as a line seal, while the other sealing face is embodied as a slide seal. However, the metering valve 8 can also be embodied as a seat-seat valve with two valve seats.

In known seat-seat valves, it has been found within the context of the present invention that the load on the control pistons, when the pressure forces are very high, is unfavorable. Even slight changes in the size of the pressure faces cause major effects on the speed of the control pistons and thus also major effects on the function of the 3/2-way valve.

Figure 2:
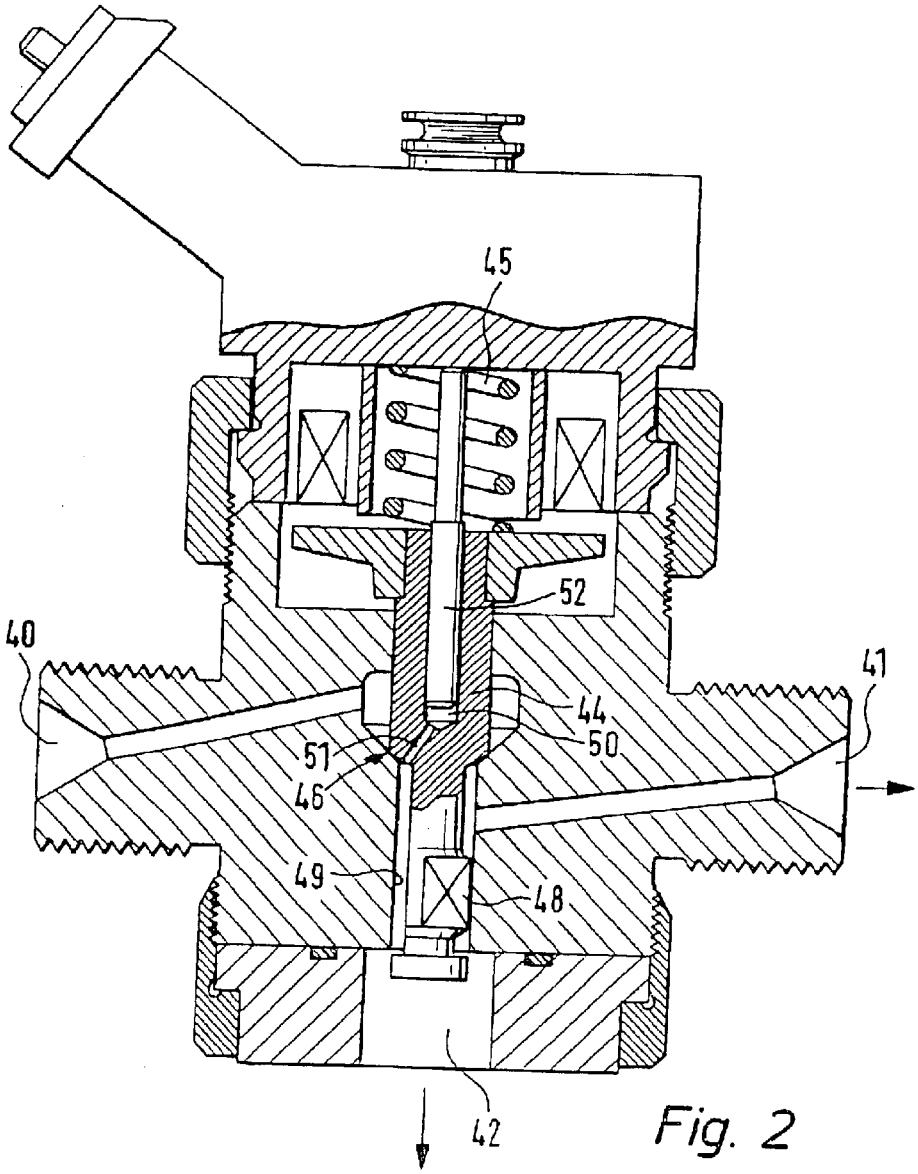
FIG. 2, in longitudinal section, a first embodiment of a 3/2-way valve of the invention, with a one-piece control piston that is controlled directly via a magnet valve.

In FIG. 2, a metering valve 8 embodied as a seat/slide valve is shown with only one control piston 44. The motion of the control piston 44 is controlled directly by an electromagnet. The direct control of the motion of the control piston is possible, however, only whenever the requisite magnet forces can be kept within certain limits. To that end, the control piston 44, in the opening and closing phase, must be as completely pressure-equalized as possible.

In the switching position, shown in FIG. 2, of the metering valve 8, a communication between a fuel inlet 40 and a connection 41 for the injector 7 (not shown in FIG. 2) is interrupted. At the same time, a communication between the connection 41 and a fuel return 42 is opened. In the switching position shown in FIG. 2, the control piston 44 is pressed against its valve seat 46 with the aid of a compression spring 45. In this switching position, the pressure at the injector can be lowered via flat faces 48 in the opened slide seal that are embodied on the circumference of the control piston 44. A central blind bore 50 is recessed out of the end of the control piston 44 toward the compression spring 45. Via a bore 51, the blind bore 50 communicates with a longitudinal bore 49, in which the control piston 44 is received in a manner capable of reciprocation. A piston 52 is received in a manner capable of reciprocation in the blind bore 50. The piston 52 is braced on the valve housing. Via the diameter of the bore 51, a desired throttling action can be established, which leads to delay in the pressure equalization.

The control piston 44 has two guides. Since the diameter of the valve seat 46 is equivalent to the upper diameter of the control piston 44, the control piston 44 is completely pressure-equalized upon opening. When current is supplied to the magnet valve to lift the control piston 44, only the forces of the compression spring 45 have to be overcome. Once the control piston 44 has lifted and the valve seat 46 has thus opened, the valve fills, via the fuel inlet 40, with the fuel that is at high pressure. A pressure wave travels at the speed of sound through the connection 41 to the injector, and the injection begins.

Since the control piston 44 has two guides, it is no longer pressure-equalized) once it has opened. Additional hydraulic forces act in the opening direction and engage the resultant circular-annular face between the lower and upper guides of the control piston. These forces require balancing, since they act counter to the compression spring 45 and prevent closure of the control piston 44. The pressure equalization is made possible by the blind bore 50. Via the bore 51, it is assured that the hydraulic pressure engages the blind bore 50 and generates forces in the closing direction of the control piston 44. These forces depend on the diameter of the blind bore 50, and the surface area of the connecting bore 51 has to be subtracted. If the pressure face in the blind bore 50 is as large as the circular-annular face between the upper and lower guides, then the control piston 44 is completely pressure-equalized. However, the cross sectional area of the blind bore 50 can also be greater than the pressure face at the control piston 44. As a result, additional forces can be generated that enable an accelerated closure. However, the additional closing force remain so slight that the force equilibrium is not postponed excessively.

The piston 52 guided in the blind bore 50 prevents fuel, subjected to pressure, from flowing permanently out of the compensation chamber into the leak fuel return. The space in the blind bore 50 that is left open by the piston 52 is called the compensation chamber. The volume of the compensation chamber is decisive for how long after the opening of the valve seat 46 the pressure equalization takes place. If the volume is great, the time until the inflow and pressure buildup is longer. Since as a rule small preinjection quantities are to be achieved, and after the preinjection the valve is meant to close again, the volume should be kept as slight as possible.

In the pressure-controlled common rail system shown in FIG. 1, fuel pressure is applied to the injector (not shown) only when injection is to be done.

Figure 3:
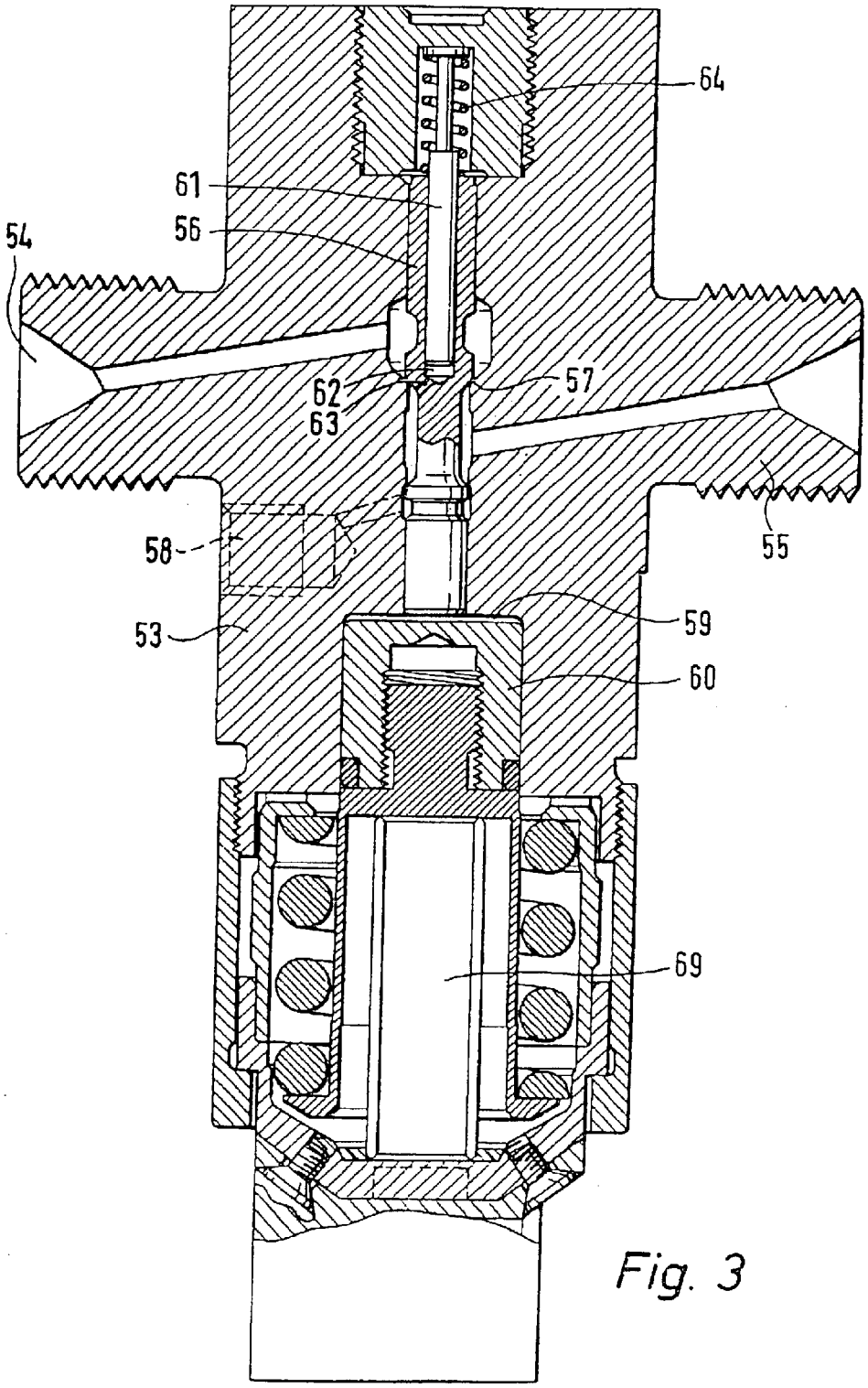
FIG. 3, in longitudinal section, a second embodiment of a 3/2-way valve of the invention, with a one-piece control piston that is controlled directly via a piezoelectric actuator.

In FIG. 3, a metering valve 8 is shown in which a control piston 56 is activated with the aid of a piezoelectric ceramic actuator.

The metering valve shown in FIG. 3 includes a valve body 53, in which a control piston 56 that is prestressed by a spring 64 is received in a manner capable of reciprocation. The control piston 56 can reciprocate between two positions via a hydraulic booster piston 60, which is actuatable via a piezoelectric actuator. In the position of the control piston 56 shown in FIG. 3, a sealing seat 57 is closed. With the sealing seat 57 closed, the communication between a fuel inlet 54 and a connection 55 for a communication with the injector (not shown) is interrupted. Simultaneously, a communication between the connection 55 and a fuel return 58 is opened. In this way, the injector (not shown) can be pressure-relieved, as long as no injection is occurring. When the control piston 56 lifts from its sealing seat 57, the communication between the connection 55 and the fuel return 58 is simultaneously interrupted. In this second position, not shown in FIG. 3, of the control piston 56, fuel subjected to high pressure flow from the fuel inlet 54 via the connection 55 to the injector, from which the injection takes place.

Upon the opening motion of the control piston 56, a hydraulic medium, such as fuel, contained in a coupling chamber 59 is positively displaced by a booster piston 60. The booster piston 60 is actuated by a piezoelectric actuator 69.

A central blind bore 62 is recessed out of the end of the control piston 56 remote from the coupling chamber 59, and a pressure-equalization piston 61 is received in this blind bore in a manner capable of reciprocation. The pressure-equalization piston 61 is braced relative to the housing on a closure screw. Via a bore 63, the blind bore 62 is in communication with the interior of the valve body 53.

The control piston 56 has two guides. Since the diameter of the high-pressure sealing seat 57 is equivalent to the upper guide diameter of the control piston 56, the control piston 56 is pressure-equalized upon opening and can accordingly be opened with only slight forces. Once the control piston 56 has lifted from its sealing seat 57, additional forces act in the opening direction, since the lower guide of the control piston 56 has a smaller diameter than the sealing seat 57. These additional forces act counter to the closing spring 64 of the control piston 56 and must be compensated for.

The pressure equalization require to compensate for the additional forces is made possible by the blind bore 62. Once the control piston 56 has lifted from its high-pressure sealing seat 57, a communication exists with the high pressure, from the blind bore 62 via the bore 63. The subjection of the blind bore 62 to pressure generates forces in the closing direction of the control piston 56. The magnitude of the forces is determined by the cross-sectional area of the blind bore 62. If the pressure face of the blind bore 62 is as large as the circular-annular face between the upper and lower control piston guide, then the control piston 56 is completely pressure-equalized and is simple to close by means of the forces of the closing spring 64. The diameter of the blind bore 62 can also be such that the area is greater than that of the pressure face at the control piston 56. As a result, additional forces for an accelerated closure of the control piston 56 can be generated. The pressure-equalization piston 61 guided in the blind bore 62 prevents fuel from flowing permanently out of the pressure-equalization chamber of the blind bore 62 into the fuel return.

By means of the piezoelectric ceramic actuator, faster switching times are made possible than in conventional valves. Moreover, the number of components used is reduced. A further advantage is that the actuator unit can be embodied as compact and short. Moreover, the stroke curve of the piezoelectric actuator can be regulated. By dispensing with a complicated servo loop, the effort and expense for production and testing are reduced considerably.

Figure 5:
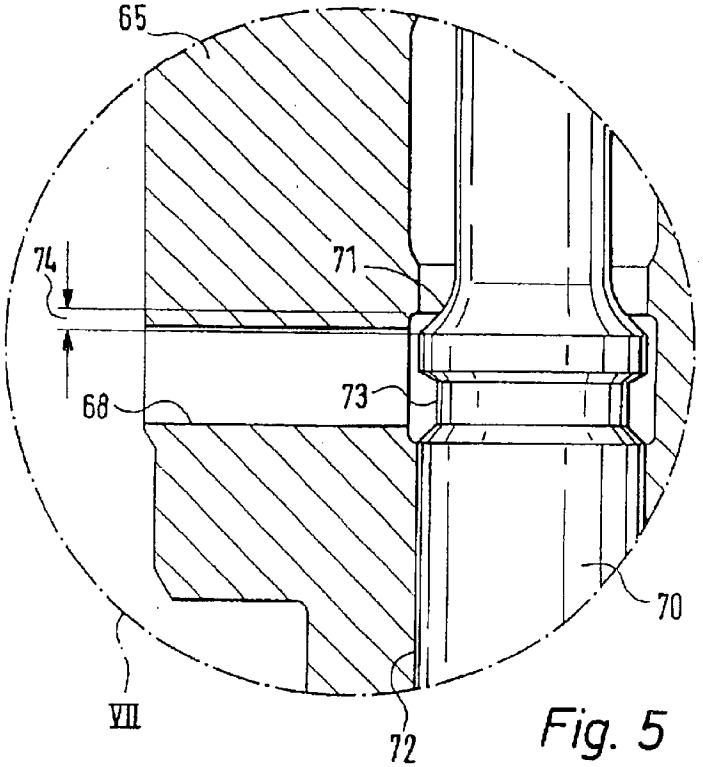
FIG. 5, an enlarged view of the detail marked VII in FIG. 4.
Figure 4:
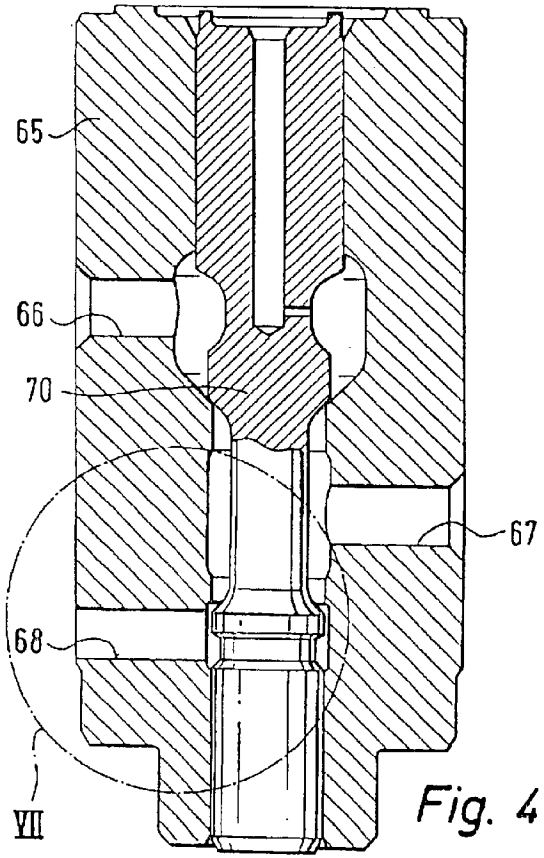
FIG. 4, in longitudinal section, an especially advantageous pressure relief of a 3/2-way valve of the invention.

In FIGS. 4 and 5, a particular form of the pressure relief is shown. This pressure relief can be employed in all the embodiments of the invention and will be described below taking a one-piece control piston as an example.

In the embodiment of the invention shown in FIGS. 4 and 5, a valve housing 65 is equipped with a fuel inlet 66. Also provided in the valve housing 65 is a communication 67 with an injector (not shown). Moreover, the valve housing 65 has a fuel return 68. A control piston 70 is received in a manner capable of reciprocation in the valve housing 65.

As best seen from the enlargement of a detail in FIG. 5, a diameter enlargement 71 is embodied on the control piston 70. The diameter enlargement 71 changes over into a cylindrical portion 72 of a larger outer diameter. A circumferential groove 73 is embodied in the cylindrical portion 72 of the control piston 70, in the region of the fuel return 68. The relief stroke of the control piston 70 is marked 74.

By means of the circumferential groove 73, an imposition of pressure on the underside of the control piston 70 is avoided. Such an imposition of pressure would act counter to the closing force of the control piston 70 and is therefore unwanted. Particularly in the opening and closing phase, any pressure surges could have an unfavorable effect on the motion of the control piston. Moreover, throttling actions are avoided by means of the circumferential groove 73, so that a faster pressure relief is achieved. By means of the encompassing groove 73, the diversion quantity can be collected directly at the relief stroke and delivered to the fuel return 68. As a result, the pressure on the back side of the control piston 70 is decoupled from the pressure after the relief stroke 74. As a result, pressure peaks on the control piston 70 upon diversion are avoided.

By means of supplying current to a magnet valve (not shown), the control chamber provided above the control piston 70 is relieved. In this way, the control piston 70 executes a stroke motion, and the communication between the fuel reservoir and the injection nozzle is brought about. The communication with the fuel return, which until now has still been open, is interrupted by the further stroke motion, since the diversion edge of the control piston 70 plunges into the valve housing 65.

The end of the injection is initiated by terminating the supply of current to the magnet valve, as a consequence of which the magnet valve closes the outlet throttle. As a result, a pressure builds up again in the control chamber through the inlet throttle in the control piston. As a result of this pressure, the control piston is thrust back into its seat. The relief cross section opens as a result. The injection nozzle and the pressure line are thus made to communicate with the fuel return. The injection pressure drops rapidly, and the control piston closes.

The foregoing relates to preferred exemplary embodiments of the invention, it being understood that other variants and embodiments thereof are possible within the spirit and scope of the invention, the latter being defined by the appended claims.

What is claimed is:

1. A 3/2-way valve for controlling the injection of fuel in a common rail injection system of an internal combustion engine, having a control piston (44) guided in a housing (53), in which the control piston (44), in a first switching position, opens a hydraulic connection between an injector (7) and a fuel return (42), and in a second switching position the control piston (44) opens a hydraulic connection between the injector (7) and a high-pressure fuel reservoir (3), and means for force balancing the control piston (44, 70), wherein the control piston (44, 70) has two guides, with a larger guide diameter and a smaller guide diameter; wherein the control piston (44, 70) has a control edge cooperating with the smaller guide diameter; wherein a blind bore (50, 62) is embodied in the end, remote from the control edge, of the control piston (44, 70); wherein the blind bore (50, 62) can be subjected to pressure via a bore (51); and wherein a throttle is provided in the bore (51).

2. The 3/2-way valve claim 1, further comprising an additional piston (52) guided in the blind bore (50, 62).

3. The 3/2-way valve of claim 2, further comprising a circumferential groove (73) embodied on the control piston (70), the groove (73), in the assembled state of the 3/2-way valve, being disposed in the region of at least one fuel return opening (68).

4. The 3/2-way valve of claim 2, wherein the control piston (44, 70) comprises a valve seat (46) whose diameter is equivalent to the larger guide diameter.

5. The 3/2-way valve of claim 2, wherein the control piston (44, 70) is prestressed by a closing spring (45).

6. The 3/2-way valve of claim 2, wherein the control piston (44, 70) is actuated via a piezoelectric actuator.

7. The 3/2-way valve of claim 1, further comprising a circumferential groove (73) embodied on the control piston (70), the groove (73), in the assembled state of the 3/2-way valve, being disposed in the region of at least one fuel return opening (68).

8. The 3/2-way valve of claim 7, wherein the control piston (44, 70) comprises a valve seat (46) whose diameter is equivalent to the larger guide diameter.

9. The 3/2-way valve of claim 7, wherein the control piston (44, 70) is prestressed by a closing spring (45).

10. The 3/2-way valve of claim 7, wherein the control piston (44, 70) is actuated via a piezoelectric actuator.

11. The 3/2-way valve of claim 1, wherein the control piston (44, 70) comprises a valve seat (46) whose diameter is equivalent to the larger guide diameter.

12. The 3/2-way valve of claim 11, wherein the control piston (44, 70) is prestressed by a closing spring (45).

13. The 3/2-way valve of claim 1, wherein the control piston (44, 70) is prestressed by a closing spring (45).

14. The 3/2-way valve of claim 1, wherein the control piston (44, 70) is actuated via a piezoelectric actuator.

15. The 3/2-way valve of claim 1, combination with an injection nozzle or a nozzle holder.

* * * * *